US009870905B2

(12) United States Patent
Hoyes

(10) Patent No.: US 9,870,905 B2
(45) Date of Patent: Jan. 16, 2018

(54) METHOD OF GENERATING ELECTRIC FIELD FOR MANIPULATING CHARGED PARTICLES

(71) Applicant: Micromass UK Limited, Wilmslow (GB)

(72) Inventor: John Brian Hoyes, Stockport (GB)

(73) Assignee: MICROMASS UK LIMITED, Wilmslow (GB)

( * ) Notice: Subject to any disclaimer, the term of this patent is extended or adjusted under 35 U.S.C. 154(b) by 115 days.

(21) Appl. No.: 14/891,197

(22) PCT Filed: May 16, 2014

(86) PCT No.: PCT/GB2014/051501
§ 371 (c)(1),
(2) Date: Nov. 13, 2015

(87) PCT Pub. No.: WO2014/184570
PCT Pub. Date: Nov. 20, 2014

(65) Prior Publication Data

US 2016/0093483 A1 Mar. 31, 2016

(30) Foreign Application Priority Data

May 16, 2013 (EP) ..... 13167991
May 16, 2013 (GB) ..... 1308847.1

(51) Int. Cl.
*H01J 49/06* (2006.01)
*H01J 49/40* (2006.01)
*H01J 49/42* (2006.01)

(52) U.S. Cl.
CPC ..... *H01J 49/062* (2013.01); *H01J 49/401* (2013.01); *H01J 49/405* (2013.01); *H01J 49/421* (2013.01)

(58) Field of Classification Search
CPC ..... H01J 49/06; H01J 49/062; H01J 49/068; H01J 49/40; H01J 49/401; H01J 49/42; H01J 49/421; H01J 49/4215; H01J 49/422; H01J 49/4225
See application file for complete search history.

(56) References Cited

U.S. PATENT DOCUMENTS 2,769,093 A * 10/1956 Hare ..... H01J 49/36 250/293
2,896,083 A * 7/1959 Hare ..... H01J 49/36 250/293
3,107,295 A 10/1963 Werner
4,052,643 A 10/1977 Yamazaki et al.
5,136,161 A 8/1992 Logan
6,919,675 B2 7/2005 Uchida et al.
8,648,298 B2 2/2014 Franzen
(Continued)

FOREIGN PATENT DOCUMENTS

GB 1409428 10/1975
IL 105249 10/1996
JP 03155034 7/1991

*Primary Examiner* — David E Smith

(57) ABSTRACT

A method of manufacturing a device for manipulating charged particles using an axial electric field as they travel along a longitudinal axis of the device is disclosed. The method comprises providing first electrodes of different lengths, supplying different voltages to these electrodes and arranging grounded electrodes between the first electrodes in order to form the desired axial potential profile.

17 Claims, 2 Drawing Sheets

(56) References Cited

U.S. PATENT DOCUMENTS

| | | | | |
|---|---|---|---|---|
| 9,275,843 | B2 * | 3/2016 | Furuhashi | H01J 49/401 |
| 2009/0206250 | A1 * | 8/2009 | Wollnik | G01N 27/622 250/290 |
| 2014/0008531 | A1 | 1/2014 | Furuhashi et al. | |
| 2014/0284471 | A1 | 9/2014 | Brown et al. | |
| 2014/0312221 | A1 | 10/2014 | Verentchikov et al. | |
| 2015/0323500 | A1 * | 11/2015 | Davis | G01N 27/624 250/281 |

* cited by examiner

METHOD OF GENERATING ELECTRIC FIELD FOR MANIPULATING CHARGED PARTICLES

CROSS-REFERENCE TO RELATED APPLICATION

This application is the National Stage of International Application No. PCT/GB2014/051501, filed 16 May 2014 which claims priority from and the benefit of United Kingdom patent application No. 1308847.1 filed on 16 May 2013 and European patent application No. 13167991.2 filed on 16 May 2013. The entire contents of these applications are incorporated herein by reference.

BACKGROUND OF THE PRESENT INVENTION

The present invention relates to device for manipulating charged particles using an electric field. The preferred embodiment relates to a device for use in a mass spectrometer for manipulating ions.

It is desirable to use electric fields to manipulate ions in mass spectrometers. Typically, the device for manipulating the ions comprises a series of electrodes spaced apart along a longitudinal axis of the device. Voltages are applied to the electrodes in order to form the desired electrical potential profile along the device so as to manipulate the ions in the desired manner. The adjacent electrodes in these devices tend to be electrically connected to each other by resistors or capacitors in order to maintain each electrode at the desired potential. It may be necessary to use a number of resistors having different resistances or a number of capacitors having different capacitances in order to achieve the desired potential profile along the device. This complicates the manufacture of the device, particularly where different capacitors are required, as it is difficult to accurately alter the capacitance of a capacitor to a desired value.

An example of a device for manipulating ions in a mass spectrometer is an orthogonal acceleration Time of Flight (TOF) mass analyser. This typically comprises a series of regions of constant electric field which differ in electric field strength, such as acceleration regions and reflectrons. In order to support these fields in the bulk of the device where the ions fly, different voltages are applied to a series of discrete electrodes that closely mimic the boundary conditions of the desired internal or bulk electric field. In the example of a single stage reflectron, the reflectron is formed from a series of cylindrical electrodes of the same length that are arranged adjacent to one another and that are connected via a potential divider consisting of resistors of equal value. The resulting electric field has discontinuities close to the surfaces of the electrodes, but these discontinuities quickly relax away from the surfaces of the electrodes to provide a smooth, constant electric field that is desired for the operation of the analyser. It is desired to minimise the complexity and number of such electrodes, but to still obtain sufficient relaxation of the electric fields in the bulk of the device so as to allow successful operation of the device.

More complex, higher order electric fields may also be created along a device by applying the appropriate potential function to a series of electrodes spaced along the device. Provided that the desired bulk field is a supported field, i.e. it satisfies Laplace's equation, then the prudent application of a potential function to the discrete electrodes that closely follows the boundary condition along a defined geometrical surface will allow the electric field to quickly relax to the desired form. The accuracy of the bulk field will depend on the accuracy of the location of the electrodes and the voltages applied to them.

Although the desired potential profile may be achieved relatively easily for certain potential profiles, this becomes more difficult when it is desired for the potential profile to follow higher order functions. Problems are also encountered if the potential profile is required to be pulsed on an off. Electrodes that define a region which requires a pulsed electric field must have capacitive dividers between the electrodes so as to provide the different voltages to the different electrodes. However such dividers are generally of low tolerance and it is difficult to accurately provide the required capacitance for each capacitor. By way of example, such problems might occur in the pulsed ion extraction region of an TOF mass analyser.

It is desired to provide an improved method of manufacturing a device for manipulating charged particles, an improved device, an improved mass spectrometer and an improved method of mass spectrometry.

SUMMARY OF THE PRESENT INVENTION

From a first aspect the present invention provides a method of manufacturing a device for manipulating charged particles using an axial electric field as they travel along a longitudinal axis of the device, said method comprising:

selecting an electrical potential profile desired to be established along the longitudinal axis of the device for manipulating the charged particles;

arranging a first plurality of electrodes along the longitudinal axis of the device, wherein the lengths of the electrodes in the direction along the longitudinal axis of the device vary as a function of the distance along the longitudinal axis of the device;

connecting one or more DC first voltage supplies to said first plurality of electrodes, wherein the one or more DC voltage supplies are configured to apply one or more DC voltages to the first plurality of electrodes in use;

arranging a second plurality of electrodes along the longitudinal axis of the device, wherein one of the second plurality of electrodes is arranged between each longitudinally adjacent pair of electrodes in the first plurality of electrodes;

connecting one or more second DC voltage supplies to said second plurality of electrodes, wherein said one or more DC voltage supplies are configured to maintain each of the second plurality of electrodes at a DC voltage in use; and selecting said lengths of the electrodes in said first plurality of electrodes, the voltages applied to the first and second plurality of electrodes and the locations of said electrodes along the longitudinal axis of the device so that said electrical potential profile is established along the longitudinal axis of the device in use;

wherein said one or more first DC voltage supplies and/or said one or more second DC voltage supplies are configured to be pulsed on and off for pulsing the electrical potential profile on and off.

The present invention varies the lengths of the electrodes in the first set of electrodes in order to establish the desired axial potential profile along the device. As it is typically more straight forward to accurately machine electrodes to their desired lengths than it is to accurately tailor voltage supplies to the desired voltages, the present invention provides an improved method of manufacture. Furthermore, by varying the lengths of the electrodes, the present invention enables non-linear axial potential profiles to be achieved without having to use electrical components having many different resistances or capacitances.

The present invention overcomes problems that are encountered when a potential profile is required to be pulsed on and off. Conventionally, the electrodes that define a region which requires a pulsed electric field are of the same length and are provided with capacitive dividers between them in order to provide the different pulsed voltages to the different electrodes that generate the desired potential profile. However, such capacitive dividers are generally of low tolerance and so it is difficult to provide the dividers with the accurate capacitance values required to form the desired potential profile accurately. In contrast to conventional arrangements, the present invention varies the lengths of the electrodes in the first set of electrodes in order to establish the desired axial potential profile along the device. As it is typically more straight forward to accurately machine electrodes to their desired lengths than it is to accurately tailor the capacitance of dividers, the present invention provides an improvement.

It is known to provide electrodes of varying lengths in arrangements such as, for example, an ion-optical lens. FIG. 1 of WO 2012/132550 discloses such an arrangement. It is also known to provide ion accelerators that are formed from electrodes of varying lengths, such as in U.S. Pat. No. 2,896,083. However, it has not previously been recognised that the lengths of the electrodes can be varied so as to overcome the above-mentioned problem and to generate a pulsed DC axial electric field with the desired accuracy.

The electrodes in the first plurality of electrodes may be connected to said one or more first voltage supplies via capacitive dividers and/or resistors so as to provide the desired voltages to the electrodes. Additionally, or alternatively, the electrodes in the second plurality of electrodes may be connected to said one or more second voltage supplies via capacitive dividers and/or resistors so as to provide the desired voltages to the electrodes.

Preferably, said one or more second DC voltage supplies are configured to maintain each of the second plurality of electrodes at the same DC voltage in use.

Preferably, in use, the electrical potential profile varies in a non-linear manner along the longitudinal axis of the device. In use, the electrical potential profile may vary along the axis of the device as a quadratic function or a higher order function.

The spacing between the electrodes in each longitudinally adjacent pair of the first plurality of electrodes may vary as a function of position along the longitudinal axis of the device.

The length of each electrode in the second plurality of electrodes is preferably selected so that longitudinally adjacent electrodes of the first plurality of electrodes are spaced apart from each other along the longitudinal axis by a distance such that a smooth axial electric field is generated within the device in use. It will be appreciated that the electric field very near to the electrodes will not be smooth, but that the electric field in the bulk of the device, where the charged particles travel, should be smooth.

The electrodes are preferably configured to provide an ion guiding path for the charged particles. The electrodes may therefore be ring-shapes, cylindrical or other tubular shapes, wherein the rings, cylinders or tubes are coaxial with the longitudinal axis.

The second plurality of electrodes are arranged along the longitudinal axis of the device, and the lengths of these electrodes in the direction along the longitudinal axis of the device preferably vary as a function of the distance along the longitudinal axis of the device.

The first and second electrodes are preferably arranged directly adjacent to each other so as to form a substantially continuous surface along the longitudinal axis of the device. This allows the electric fields generated by the first plurality of electrodes to relax and become superimposed to form a smooth axial electric field along the device. This arrangement is in contrast to conventional devices, wherein electrodes of constant voltage are not provided between the electrodes for generating the axial field.

The one or more first voltage supplies may be configured to maintain each of the first plurality of electrodes at the same voltage in use, wherein this voltage is different to the voltage applied to the second plurality of electrodes by the second voltage supply. In this arrangement, the lengths of the first plurality of electrodes preferably vary in a non-linear manner as a function of position along the device so that a non-linear electrical potential profile is formed along the device in use.

Alternatively, the first plurality of electrodes consists of electrodes that are arranged sequentially along the longitudinal axis of the device, and the voltages applied to the electrodes preferably vary linearly as a function of the position of the electrode within the sequence. The voltage applied to the nth electrode in the sequence may be equivalent to $a.n+b$ volts, where "a" is $\neq 0$ and "b" is a constant or zero. In this arrangement, the lengths of the first plurality of electrodes preferably vary in a linear or higher order manner as a function of position along the device so that a non-linear electrical potential profile is formed along the device in use.

Alternatively, the voltages applied to the electrodes may vary in a quadratic manner as a function of the position of the electrode within the sequence. The voltage applied to the nth electrode in the sequence may be equivalent to $a.n^2+b.n+c$ volts, wherein $a \neq 0$ and b and c are zero or a constant.

Alternatively, the voltages applied to the electrodes may vary in a cubic manner as a function of the position of the electrode within the sequence. The voltage applied to the nth electrode in the sequence may be equivalent to $a.n^3+b.n^2+c.n+d$ volts, wherein $a \neq 0$ and b, c and d are constants or zero. Voltage functions that are of higher order than cubic functions are also contemplated.

The second voltage supply maintains each of the second plurality of electrodes at ground voltage or another non-zero voltage.

The first plurality of electrodes consists of electrodes that are arranged sequentially along the longitudinal axis of the device, and the lengths of the electrodes may vary linearly as a function of the position of the electrode within the sequence. The length of the nth electrode in the sequence may be equivalent to $a.n+b$ units of length, wherein $a \neq 0$ and b is a constant or zero.

Alternatively, the lengths of the electrodes may vary in a quadratic manner as a function of the position of the electrode within the sequence. The length of the nth electrode in the sequence may be equivalent to $a.n^2+b.n+c$ units of length, wherein $a \neq 0$, and b and c are constants or zero.

Alternatively, the lengths of the electrodes may vary in a cubic manner as a function of the position of the electrode within the sequence. The length of the nth electrode in the sequence may be equivalent to $a.n^3+b.\ n^2+c.n+d$ units of length, wherein $a \neq 0$ and b, c and d are constants or zero. Functions that are of higher order than cubic functions are also contemplated.

The present invention may combine the effect of varying the lengths of the first electrodes with the effects of applying different voltage profiles to the first electrodes. For example, the lengths of the electrodes in the first plurality of electrodes may vary linearly along the length of the device and the voltages applied to these electrodes may also vary linearly along the device so as to create a quadratic axial electrical potential along the device. The lengths and/or voltages may follow higher order functions than linear functions so as to create higher axial electrical potential profiles that follow higher order functions than a quadratic function.

The length of any given electrode in the first plurality of electrodes combined with the length of an adjacent electrode of the second plurality of electrodes is preferably constant at any point along the device. As such, as the electrodes in the first plurality of electrodes become shorter along the device, the electrodes in the second plurality of electrodes become longer along the device.

The number of electrodes in said first and/or second plurality of electrodes is preferably ≥5. The number of electrodes in said first plurality of electrodes and/or second plurality of electrodes may be selected from the group consisting of: >3; >4; >5; >6; >7; >8; >9; >10; >15; >20; >25; or >30.

Preferably, at least x electrodes in said first plurality of electrodes have different lengths, wherein x is selected from the group consisting of: >2; >3; >4; >5; >6; >7; >8; >9; >10; >15; >20; >25; >30; >35; >40; >45; >50; >60; >70; >80; >90; and >100.

Preferably, at least y electrodes in said second plurality of electrodes have different lengths, wherein y is selected from the group consisting of: >2; >3; >4; >5; >6; >7; >8; >9; >10; >15; >20; >25; >30; >35; >40; >45; >50; >60; >70; >80; >90; and >100.

The electrical potential profile preferably varies along the longitudinal direction of the device, in use, so as to drive charged particles through the device or trap charged particles.

Said electrical potential profile is preferably the potential profile arranged substantially along the central axis of the device. The electrodes preferably surround said axis.

The voltages applied to the electrodes preferably create supported Laplacian electric fields in use.

The present invention is also advantageous in situations where the electrical potential profile is not pulsed on and off. Therefore, it is not essential to the present invention that the first and/or second DC voltage supply is configured to be pulsed on and off for pulsing the electrical potential profile on and off. Additionally, or alternatively, it is not essential to the present invention that the first and/or second voltage supply is a DC voltage supply. For example, the present invention provides an advantage by varying the lengths of the electrodes in the first set of electrodes in order to establish the desired axial potential profile along the device. As it is typically more straight forward to accurately machine electrodes to their desired lengths than it is to accurately tailor voltage supplies to the desired voltages, the present invention provides an improved device. Furthermore, by varying the lengths of the electrodes, the present invention enables non-linear axial potential profiles to be achieved without having to use electrical components having many different resistances or capacitances.

Accordingly, from a second aspect the present invention provides a method of manufacturing a device for manipulating charged particles using an axial electric field as they travel along a longitudinal axis of the device, said method comprising:

selecting an electrical potential profile desired to be established along the longitudinal axis of the device for manipulating the charged particles;

arranging at least a first plurality of electrodes along the longitudinal axis of the device, wherein the lengths of the electrodes in the direction along the longitudinal axis of the device vary as a function of the distance along the longitudinal axis of the device;

connecting one or more first voltage supplies to said first plurality of electrodes, wherein the one or more voltage supplies are configured to apply one or more voltages to the first plurality of electrodes in use;

arranging a second plurality of electrodes along the longitudinal axis of the device, wherein one of the second plurality of electrodes is arranged between each longitudinally adjacent pair of electrodes in the first plurality of electrodes;

connecting one or more second voltage supplies to said second plurality of electrodes, wherein the voltage supply are configured to maintain each of the second plurality of electrodes at a voltage in use; and selecting said lengths of the electrodes in said first plurality of electrodes, the voltages applied to the first and second plurality of electrodes and the locations of said electrodes along the longitudinal axis of the device so that said electrical potential profile is established along the longitudinal axis of the device in use.

The electrical potential profile may be an electrostatic potential profile, i.e. that is not pulsed on and off.

Preferably, said one or more second voltage supplies are configured to maintain each of the second plurality of electrodes at the same voltage in use.

The first and/or second voltage supplies may be DC voltage supplies such that the electrodes are maintained at DC voltages in use.

The present invention also provides a device manufactured according to any one of the methods described herein.

From the first aspect, the present invention provides a device for manipulating charged particles using an axial electric field as they travel along a longitudinal axis of the device, said device comprising:

a first plurality of electrodes arranged along the longitudinal axis of the device, wherein the lengths of the electrodes in the direction along the longitudinal axis of the device vary as a function of the distance along the longitudinal axis of the device;

one or more first DC voltage supplies connected to said first plurality of electrodes, wherein the one or more DC voltage supplies are configured to apply one or more DC voltages to the first plurality of electrodes in use;

a second plurality of electrodes arranged along the longitudinal axis of the device, wherein one of the second plurality of electrodes is arranged between each longitudinally adjacent pair of electrodes in the first plurality of electrodes;

one or more second DC voltage supplies connected to said second plurality of electrodes, wherein the DC voltage supply is configured to maintain each of the second plurality of electrodes at a DC voltage in use;

wherein the first and second plurality of electrodes are arranged along the longitudinal axis of the device and the first and second voltage supplies are selected such that a non-linear electric potential profile is established along the longitudinal axis of the device in use; and wherein the one or more first DC voltage supplies and/or said one or more second DC voltage supplies are configured to be pulsed on and off for pulsing the electrical potential profile on and off.

Preferably, said one or more second DC voltage supplies are configured to maintain each of the second plurality of electrodes at the same DC voltage in use.

According to the second aspect, the present invention also provides a device for manipulating charged particles using an axial electric field as they travel along a longitudinal axis of the device, said device comprising:

a first plurality of electrodes arranged along the longitudinal axis of the device, wherein the lengths of the electrodes in the direction along the longitudinal axis of the device vary as a function of the distance along the longitudinal axis of the device;

one or more first voltage supplies connected to said first plurality of electrodes, wherein the one or more voltage supplies are configured to apply one or more voltages to the first plurality of electrodes in use;

a second plurality of electrodes arranged along the longitudinal axis of the device, wherein one of the second plurality of electrodes is arranged between each longitudinally adjacent pair of electrodes in the first plurality of electrodes;

one or more second voltage supplies connected to said second plurality of electrodes, wherein the voltage supply is configured to maintain each of the second plurality of electrodes at a voltage in use; and wherein the first and second plurality of electrodes are arranged along the longitudinal axis of the device and the first and second voltage supplies are selected such that a non-linear electric potential profile is established along the longitudinal axis of the device in use.

Preferably, said one or more second voltage supplies are configured to maintain each of the second plurality of electrodes at the same voltage in use.

The device of the first or second aspects of the present invention may be an ion mirror, or an acceleration region or reflectron of a Time of Flight mass analyser. The present invention also provides a mass spectrometer or ion mobility spectrometer comprising a device as described herein, wherein the charged particles are preferably ions.

The device may be a Time of Flight mass analyser, wherein the device is configured so that ions enter the device orthogonal to the longitudinal axis, and wherein the device is configured to pulse or establish said electric potential profile along the entire length of the longitudinal axis of the device such that ions are accelerated along the longitudinal axis and separate according to their mass to charge ratios.

The device may comprise any one or combination of features described herein in relation to the methods of manufacturing the device.

The device is preferably a reflectron for reflecting ions; an ion extraction device for accelerating pulses of ions; or a Time of Flight mass analyser.

The present invention also provides a method of manipulating charged particles comprising using a device as described herein, comprising using said electrical potential profile to manipulate the charged particles. The present invention provides a method of manipulating charged particles, or a method of mass spectrometry or ion mobility spectrometry comprising providing a device or spectrometer as described herein; applying said one or more voltages to the first plurality of electrodes with said one or more first voltage supplies, and applying said one or more voltages to the second plurality of electrodes with said one or more second voltage supplies, such that a non-linear electric potential profile is established along a longitudinal axis of the device; and manipulating charged particles using the electric potential profile as they travel along the longitudinal axis of the device.

The methods, devices or spectrometers according to the second aspect of the present invention may have any one, or any combination, of the preferred or optional features described herein in relation to the first aspect of the invention.

Although only a first and second plurality of electrodes have been described, it is contemplated that a third plurality of electrodes may be arranged along the longitudinal axis of the device. One of the third plurality of electrodes may be arranged between pair of longitudinally adjacent electrodes of the first plurality of electrodes.

The lengths of the electrodes in the third plurality of electrodes in the direction along the longitudinal axis of the device may vary as a function of the distance along the longitudinal axis of the device. The length may vary linearly, quadratically, cubically or by a higher order function, as described with respect to the first plurality of electrodes.

One or more third voltage supplies may be connected to said third plurality of electrodes, wherein the one or more voltage supplies are configured to apply one or more voltages to the third plurality of electrodes in use. The third plurality of electrodes may be maintained at the same voltage or at voltages following a linear, quadratic, cubic or higher order function as described above with respect to the first plurality of electrodes.

The electrodes of the first, second and third plurality of electrodes are preferably arranged directly adjacent to each other so as to form a substantially continuous surface along the longitudinal axis of the device.

The voltage(s) applied to the third plurality of electrodes are preferably DC voltages, which may or may not be pulsed on and off.

A fourth or further set of plurality of electrodes may also be employed.

The present invention also provides a method of mass spectrometry comprising the method of manipulating charged particles described herein, and further comprising mass analysing the charged particles.

The spectrometer may comprise:

(a) an ion source selected from the group consisting of: (i) an Electrospray ionisation ("ESI") ion source; (ii) an Atmospheric Pressure Photo Ionisation ("APPI") ion source; (iii) an Atmospheric Pressure Chemical Ionisation ("APCI") ion source; (iv) a Matrix Assisted Laser Desorption Ionisation ("MALDI") ion source; (v) a Laser Desorption Ionisation ("LDI") ion source; (vi) an Atmospheric Pressure Ionisation ("API") ion source; (vii) a Desorption Ionisation on Silicon ("DIOS") ion source; (viii) an Electron Impact ("EI") ion source; (ix) a Chemical Ionisation ("CI") ion source; (x) a Field Ionisation ("FI") ion source; (xi) a Field Desorption ("FD") ion source; (xii) an Inductively Coupled Plasma ("ICP") ion source; (xiii) a Fast Atom Bombardment ("FAB") ion source; (xiv) a Liquid Secondary Ion Mass Spectrometry ("LSIMS") ion source; (xv) a Desorption Electrospray Ionisation ("DESI") ion source; (xvi) a Nickel-63 radioactive ion source; (xvii) an Atmospheric Pressure Matrix Assisted Laser Desorption Ionisation ion source; (xviii) a Thermospray ion source; (xix) an Atmospheric Sampling Glow Discharge Ionisation ("ASGDI") ion source; (xx) a Glow Discharge ("GD") ion source; (xxi) an Impactor ion source; (xxii) a Direct Analysis in Real Time ("DART") ion source; (xxiii) a Laserspray Ionisation ("LSI") ion source; (xxiv) a Sonicspray Ionisation ("SSI") ion source; (xxv) a Matrix Assisted Inlet Ionisation ("MAII") ion source; and (xxvi) a Solvent Assisted Inlet Ionisation ("SAII") ion source; and/or (b) one or more continuous or pulsed ion sources; and/or (c) one or more ion guides; and/or (d) one or more ion mobility separation devices and/or one or more Field Asymmetric Ion Mobility Spectrometer devices; and/or (e) one or more ion traps or one or more ion trapping regions; and/or (f) one or more collision, fragmentation or reaction cells selected from the group consisting of: (i) a Collisional Induced Dissociation ("CID") fragmentation device; (ii) a Surface Induced Dissociation ("SID") fragmentation device; (iii) an Electron Transfer Dissociation ("ETD") fragmentation device; (iv) an Electron Capture Dissociation ("ECD") fragmentation device; (v) an Electron Collision or Impact Dissociation fragmentation device; (vi) a Photo Induced Dissociation ("PID") fragmentation device; (vii) a Laser Induced Dissociation fragmentation device; (viii) an infrared radiation induced dissociation device; (ix) an ultraviolet radiation induced dissociation device; (x) a nozzle-skimmer interface fragmentation device; (xi) an in-source fragmentation device; (xii) an in-source Collision Induced Dissociation fragmentation device; (xiii) a thermal or temperature source fragmentation device; (xiv) an electric field induced fragmentation device; (xv) a magnetic field induced fragmentation device; (xvi) an enzyme digestion or enzyme degradation fragmentation device; (xvii) an ion-ion reaction fragmentation device; (xviii) an ion-molecule reaction fragmentation device; (xix) an ion-atom reaction fragmentation device; (xx) an ion-metastable ion reaction fragmentation device; (xxi) an ion-metastable molecule reaction fragmentation device; (xxii) an ion-metastable atom reaction fragmentation device; (xxiii) an ion-ion reaction device for reacting ions to form adduct or product ions; (xxiv) an ion-molecule reaction device for reacting ions to form adduct or product ions; (xxv) an ion-atom reaction device for reacting ions to form adduct or product ions; (xxvi) an ion-metastable ion reaction device for reacting ions to form adduct or product ions; (xxvii) an ion-metastable molecule reaction device for reacting ions to form adduct or product ions; (xxviii) an ion-metastable atom reaction device for reacting ions to form adduct or product ions; and (xxix) an Electron Ionisation Dissociation ("EID") fragmentation device; and/or (g) a mass analyser selected from the group consisting of: (i) a quadrupole mass analyser; (ii) a 2D or linear quadrupole mass analyser; (iii) a Paul or 3D quadrupole mass analyser; (iv) a Penning trap mass analyser; (v) an ion trap mass analyser; (vi) a magnetic sector mass analyser; (vii) Ion Cyclotron Resonance ("ICR") mass analyser; (viii) a Fourier Transform Ion Cyclotron Resonance ("FTICR") mass analyser; (ix) an electrostatic or orbitrap mass analyser; (x) a Fourier Transform electrostatic or orbitrap mass analyser; (xi) a Fourier Transform mass analyser; (xii) a Time of Flight mass analyser; (xiii) an orthogonal acceleration Time of Flight mass analyser; and (xiv) a linear acceleration Time of Flight mass analyser; and/or (h) one or more energy analysers or electrostatic energy analysers; and/or (i) one or more ion detectors; and/or (j) one or more mass filters selected from the group consisting of: (i) a quadrupole mass filter; (ii) a 2D or linear quadrupole ion trap; (iii) a Paul or 3D quadrupole ion trap; (iv) a Penning ion trap; (v) an ion trap; (vi) a magnetic sector mass filter; (vii) a Time of Flight mass filter; and (viii) a Wien filter; and/or (k) a device or ion gate for pulsing ions; and/or (l) a device for converting a substantially continuous ion beam into a pulsed ion beam.

The spectrometer may further comprise either:

(i) a C-trap and an Orbitrap® mass analyser comprising an outer barrel-like electrode and a coaxial inner spindle-like electrode, wherein in a first mode of operation ions are transmitted to the C-trap and are then injected into the Orbitrap® mass analyser and wherein in a second mode of operation ions are transmitted to the C-trap and then to a collision cell or Electron Transfer Dissociation device wherein at least some ions are fragmented into fragment ions, and wherein the fragment ions are then transmitted to the C-trap before being injected into the Orbitrap® mass analyser; and/or (ii) a stacked ring ion guide comprising a plurality of electrodes each having an aperture through which ions are transmitted in use and wherein the spacing of the electrodes increases along the length of the ion path, and wherein the apertures in the electrodes in an upstream section of the ion guide have a first diameter and wherein the apertures in the electrodes in a downstream section of the ion guide have a second diameter which is smaller than the first diameter, and wherein opposite phases of an AC or RF voltage are applied, in use, to successive electrodes.

The spectrometer may comprise a device arranged and adapted to supply an AC or RF voltage to the electrodes. The AC or RF voltage preferably has an amplitude selected from the group consisting of: (i) <50 V peak to peak; (ii) 50-100 V peak to peak; (iii) 100-150 V peak to peak; (iv) 150-200 V peak to peak; (v) 200-250 V peak to peak; (vi) 250-300 V peak to peak; (vii) 300-350 V peak to peak; (viii) 350-400 V peak to peak; (ix) 400-450 V peak to peak; (x) 450-500 V peak to peak; and (xi) >500 V peak to peak.

The AC or RF voltage preferably has a frequency selected from the group consisting of: (i) <100 kHz; (ii) 100-200 kHz; (iii) 200-300 kHz; (iv) 300-400 kHz; (v) 400-500 kHz; (vi) 0.5-1.0 MHz; (vii) 1.0-1.5 MHz; (viii) 1.5-2.0 MHz; (ix) 2.0-2.5 MHz; (x) 2.5-3.0 MHz; (xi) 3.0-3.5 MHz; (xii) 3.5-4.0 MHz; (xiii) 4.0-4.5 MHz; (xiv) 4.5-5.0 MHz; (xv) 5.0-5.5 MHz; (xvi) 5.5-6.0 MHz; (xvii) 6.0-6.5 MHz; (xviii) 6.5-7.0 MHz; (xix) 7.0-7.5 MHz; (xx) 7.5-8.0 MHz; (xxi) 8.0-8.5 MHz; (xxii) 8.5-9.0 MHz; (xxiii) 9.0-9.5 MHz; (xxiv) 9.5-10.0 MHz; and (xxv) >10.0 MHz.

The preferred embodiments enable a supported bulk field to be created using fewer electrodes and fewer discrete voltages. Preferably, the electrodes are located on a geometrical boundary of the device. For example, in a cylindrical reflection the electrodes form the cylindrical inner surface of the reflectron.

The electrical potential profile established along the longitudinal axis of the device according to the present invention may be established over a cylindrical volume or over an annular volume that extends along the longitudinal axis.

The device comprises two or more sets of electrodes, wherein the same voltage is applied to electrodes within a given set and different voltages are applied to the electrodes of different sets. The length of each electrode along the device within a given set of electrodes varies according to the position of the electrode along the geometrical boundary of the device so that the desired bulk field is created in the device. This is in contrast to conventional techniques, wherein the electrodes have the same length and the voltage applied to each electrode differs so as to form the desired bulk field.

The principle of superposition means that the solution to the electric fields due to each of the individual electrodes can be added together to obtain the final electric field. In practice, it is easier to calculate the correct length for each electrode in a set of electrodes if they follow a well defined geometric surface, for example, such as the cylindrical surface of the reflectron mentioned above.

Greater accuracy and faster relaxation of the required bulk electric field will be obtained by using more electrodes per unit length of the device, although the device then becomes more complex. The number of electrodes per unit length must be selected so as to provide a balance between the complexity of the device and sufficient electric field relaxation.

BRIEF DESCRIPTION OF THE DRAWINGS

Various embodiments of the present invention will now be described, by way of example only, and with reference to the accompanying drawings, in which.

DETAILED DESCRIPTION OF PREFERRED EMBODIMENTS

In order to illustrate the present invention the simple case of the so called "perfectron" will now be described. A "perfectron" is a cylindrical device having a parabolic potential function arranged along the length of its central axis and having defined potential surfaces at the front and rear ends of the device.

Figure 1:
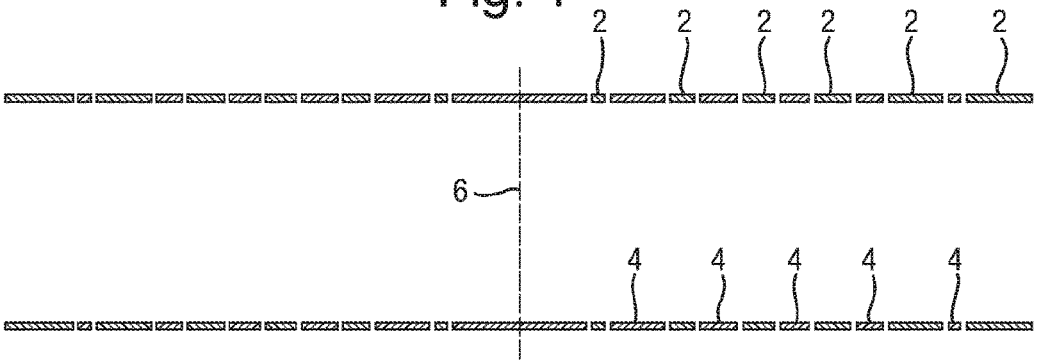
FIG. 1 shows a schematic of a device according to a preferred embodiment of the present invention.

FIG. 1 shows a preferred embodiment of a "perfectron" on the right hand side of the vertical dashed line. The "perfectron" comprising two sets of concentric ring electrodes 2,4 arranged along a longitudinal axis of the device and having front and rear equipotential surfaces. Alternate electrodes in the device form the first set of electrodes 4 and are connected a ground potential. The electrodes in this set become progressively shorter in the longitudinal direction of the device as one moves away from the front end 6 of the device, wherein the front end of the device is arranged at the vertical dashed line. The second set of electrodes 2 is connected to the ion mirror potential and comprises electrodes 2 that become progressively longer in the longitudinal direction of the device as one moves away from the front end 6 of the device. The lengths of the electrodes 2 increase as a quadratic function of their distances from the front end 6 of the device. In order to eliminate boundary condition effects of the device and to examine the true behaviour of the device, a mirror image of the device is considered to be arranged on the left hand side of the vertical dashed line.

FIGS. 2A to 2D show simulations of the electrical potential along the device (i.e. within the arrangement on the right side of the vertical dashed line in FIG. 1) for different radial positions within the device. The simulations assume that the device has a radius of 3 cm and a length of 20 cm. The simulation also assumes that the arrangement on the left side of the vertical dashed line mirrors the device on the right side of the vertical dashed line. The simulation assumes that the pitch of the electrodes along the length of the device is 2 cm (i.e. ten electrodes between the entrance and exit electrodes) and that the electrodes vary in length from 0.025 to 10 mm. The simulation assumes that the first set of electrodes 4 are maintained at ground potential and that each electrode in the second set of electrodes 2 is maintained at 200 V.

Figure 2A:
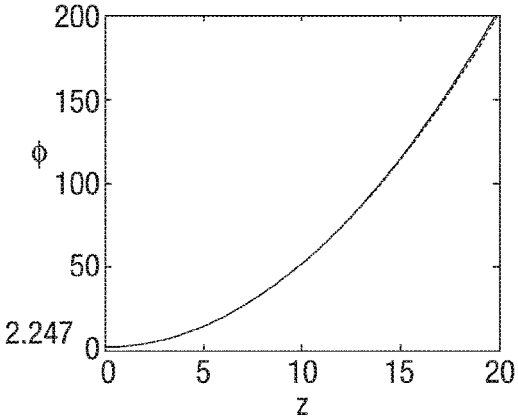
FIGS. 2A to 2D show the potential profiles maintained along the device of FIG. 1 at different radial positions within the device.

FIG. 2A shows the potential φ maintained along the central axis z of the device due to the voltages applied to the first and second sets of electrodes 2,4. It can be seen that the potential profile along the central axis of the device is quadratic.

Figure 2B:
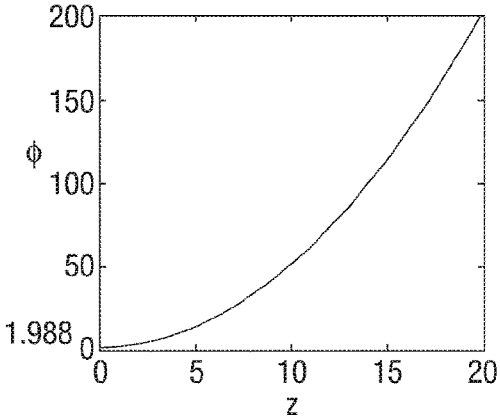

FIG. 2B shows the potential φ maintained along the device at a radius of 1 cm from the central axis z, due to the voltages applied to the first and second sets of electrodes 2,4. It can be seen that the potential profile along the device at this radius is substantially quadratic.

Figure 2C:
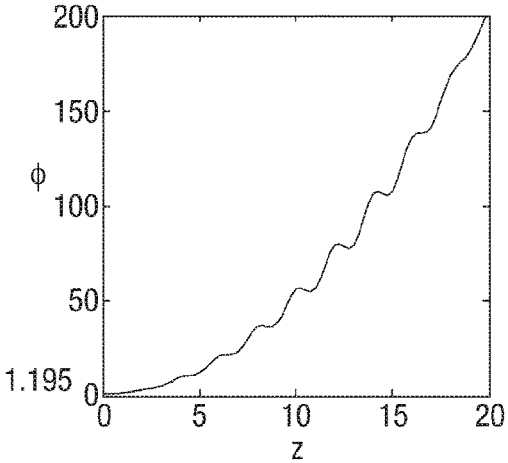

FIG. 2C shows the potential φ maintained along the device at a radius of 2 cm from the central axis z, due to the voltages applied to the first and second sets of electrodes 2,4. It can be seen that the potential profile along the device at this radius follows a generally quadratic pattern, although there is a significant ripple in the potential function due to the electrode structure.

Figure 2D:
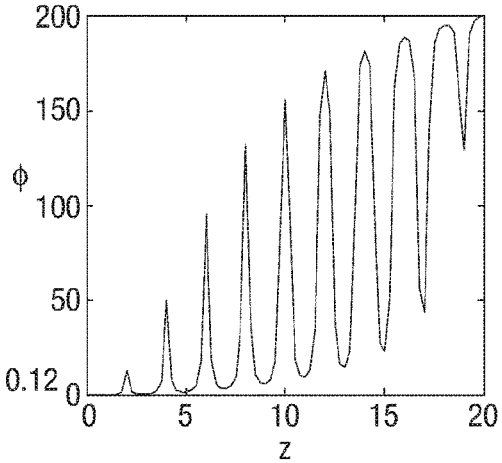

FIG. 2D shows the potential φ maintained along the device at a radius of 2.9 cm from the central axis z, due to the voltages applied to the first and second sets of electrodes 2,4. It can be seen that the potential profile along the device at this radius is significantly distorted from the desired quadratic function.

FIGS. 2A to 2D illustrate that the electrode structure of the preferred embodiment can be used to generate a quadratic potential along the device for manipulating ions using only two voltages, i.e. ground and 200 V. This is achieved by varying the lengths of the electrodes in the second set of electrodes 2.

Figure 3:
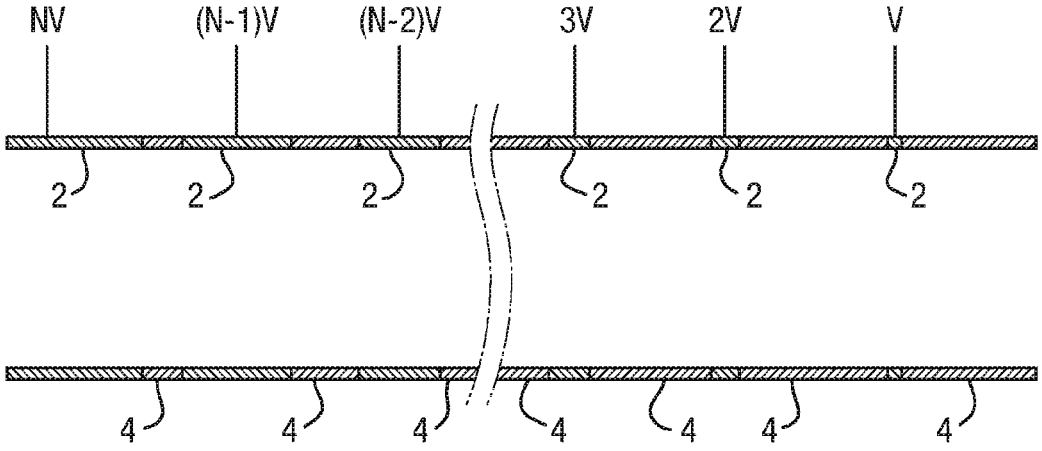
FIG. 3 shows a schematic of the electrode structure and voltages that may be applied to the electrodes in an embodiment of the present invention.

FIG. 3 shows another embodiment of a device having a first set of electrodes 4 and a second set of N electrodes 2. The set of curved, dashed lines indicate that the number of electrodes in the device may be greater than the number shown in FIG. 3. The electrodes in the device alternate between electrodes in the first set 4 and electrodes in the second set 2. The electrodes 2,4 are arranged directly adjacent to each other so as to form a continuous, flush surface. The first set of electrodes 4 are electrically grounded and decrease in length from the right side to left side of the device. The electrodes in the second set of electrodes 2 increase in length from the right side of the device to the left side of the device. The electrodes increase in length in a linear manner as a function of their distance from the right side of the device. The voltages applied to the second set of electrodes 2 increase from the right side of the device to the left side of the device. The voltages increase in a linear manner such that the Nth electrode of the second set of electrodes 2 is maintained at N volts. A linear divider formed from a plurality of resistors having the same resistance is used to supply the second set of electrodes 2 with the different voltages.

The effect of linearly increasing the length of the electrodes in the second set of electrodes 2 and linearly increasing the voltages applied to these electrodes results in a quadratic axial electric field being generated along the device. The quadratic electric field increases in amplitude in the same direction along the device that the voltages and lengths of the electrodes increase. It will therefore be appreciated that the preferred embodiment enables a quadratic electric field to be established along the device using a linear voltage divider comprising only resistors of the same value.

Figure 4:
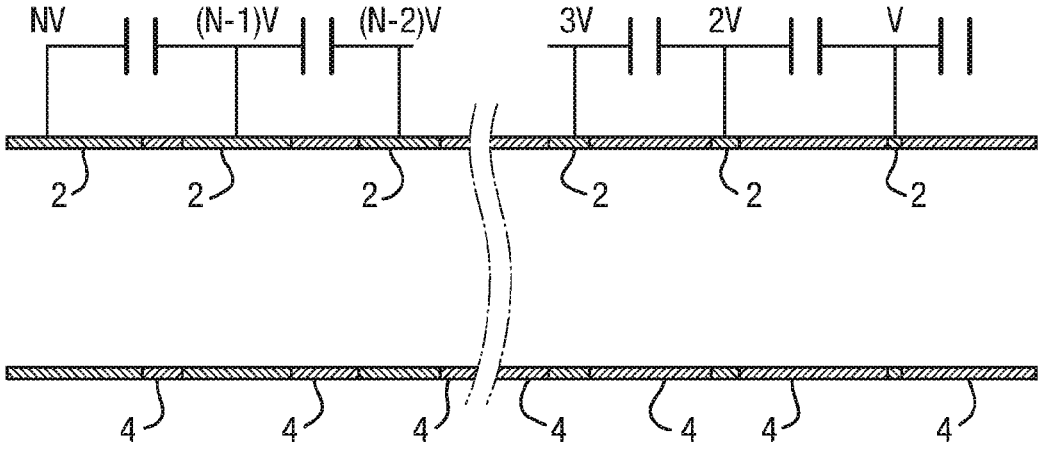
FIG. 4 shows a schematic of the electrode structure and voltages that may be applied to the electrodes in another embodiment of the present invention.

FIG. 4 shows an embodiment that is substantially the same as that of FIG. 3 except that the voltage divider uses capacitors of the same capacitance value, rather than resistors, in order to form the voltage gradient along the second set of electrodes. A quadratic axial electric field is formed within the device, as described above with respect to FIG. 3. The embodiment of FIG. 4 is particularly advantageous in the event that the axial electric field is desired to be pulsed on and off.

The technique of the present invention may be referred to as Electrode Width Modulation (EWM) in analogy to pulse width modulation techniques employed in electronic power converters, except that in the present invention the modulation occurs spatially in terms of the width of the electrodes (i.e. length along the device) rather than temporally.

The accuracy of the electric field that can be achieved according to the present invention is greater than that of conventional techniques since it is relatively easy to precisely machine electrodes to the desired length to provide the desired potential profile along the device. The technique of the present invention is therefore more accurate than the conventional techniques, which rely upon using resistive or capacitive dividers of different values between electrodes in order to provide a voltage profile along the electrodes. This is particularly the case when trying to achieve higher order potential functions which deviate from commercially available preferred values. Furthermore, as all the electrodes in a particular set of electrodes may be connected to the same voltage output in the preferred embodiment of the present invention, the device is ideally suited to the rapid pulsing of electric fields which require support over large physical volumes, for example, such as those found in orthogonal acceleration TOF technology.

The present invention has general applicability to the creation of any electrostatic or pulsed field, provided that the boundary conditions are known. For example, the present invention may be used to generate a hyperlogarithmic field along the length of the device. This may be useful in devices such as, for example, orthogonal acceleration TOF devices.

Although the present invention has been described with reference to preferred embodiments, it will be understood by those skilled in the art that various changes in form and detail may be made without departing from the scope of the invention as set forth in the accompanying claims.

For example, although it is preferred that the device of the present invention is for manipulating ions in a mass spectrometer, it is also contemplated that the device be used for manipulating charged particles in other applications. Examples of such other applications are the manipulation of electrons in electron microscopes, electron spectrometers or other devices.

The invention claimed is:

1. A method of manufacturing a device for manipulating charged particles using an axial electric field as they travel along a longitudinal axis of the device, said method comprising:

selecting an electrical potential profile desired to be established along the longitudinal axis of the device for manipulating the charged particles;

arranging at least a first plurality of electrodes along the longitudinal axis of the device, wherein the lengths of the electrodes in the direction along the longitudinal axis of the device vary as a function of the distance along the longitudinal axis of the device;

connecting one or more first DC voltage supplies to said first plurality of electrodes, wherein the one or more DC voltage supplies are configured to apply one or more DC voltages to the first plurality of electrodes in use;

arranging a second plurality of electrodes along the longitudinal axis of the device, wherein one of the second plurality of electrodes is arranged between each longitudinally adjacent pair of electrodes in the first plurality of electrodes;

connecting one or more second DC voltage supplies to said second plurality of electrodes, wherein said one or more second DC voltage supplies are configured to maintain each of the second plurality of electrodes at a DC voltage in use; and selecting said lengths of the electrodes in said first plurality of electrodes, the voltages applied to the first and second plurality of electrodes and the locations of said electrodes along the longitudinal axis of the device so that said electrical potential profile is established along the longitudinal axis of the device in use;

wherein said one or more first DC voltage supplies and/or said one or more second DC voltage supplies are configured to be pulsed on and off for pulsing the electrical potential profile on and off.

2. The method of claim 1, wherein in use the electrical potential profile varies in a non-linear manner along the longitudinal axis of the device; or wherein in use the electrical potential profile varies along the axis of the device as a quadratic function or a higher order function.

3. The method of claim 1, wherein the length of each electrode in the second plurality of electrodes is selected so that longitudinally adjacent electrodes of the first plurality of electrodes are spaced apart from each other along the longitudinal axis by a distance such that a substantially smooth axial electric field is generated within the device in use.

4. The method of claim 1, wherein the first and second electrodes are arranged directly adjacent to each other so as to form a substantially continuous surface along the longitudinal axis of the device.

5. The method of claim 1, wherein the one or more first voltage supplies are configured to maintain each of the first plurality of electrodes at the same voltage in use, and wherein this voltage is different to the voltage(s) applied to the second plurality of electrodes by the second voltage supply.

6. The method of claim 1, wherein the first plurality of electrodes consists of electrodes that are arranged sequentially along the longitudinal axis of the device, and wherein the voltages applied to these electrodes vary linearly as a function of the position of the electrode within the sequence.

7. The method of claim 1, wherein the first plurality of electrodes consists of electrodes that are arranged sequentially along the longitudinal axis of the device, and wherein the voltages applied to these electrodes vary in a quadratic manner as a function of the position of the electrode within the sequence.

8. The method of claim 1, wherein the first plurality of electrodes consists of electrodes that are arranged sequentially along the longitudinal axis of the device, and wherein the lengths of these electrodes vary linearly as a function of the position of the electrode within the sequence.

9. The method of claim 1, wherein the first plurality of electrodes consists of electrodes that are arranged sequentially along the longitudinal axis of the device, and wherein the lengths of these electrodes vary in a quadratic manner as a function of the position of the electrode within the sequence.

10. The method of claim 1, wherein the length of any given electrode in the first plurality of electrodes combined with the length of an adjacent electrode of the second plurality of electrodes is constant at any point along the device.

11. The method of claim 1, wherein the number of electrodes in said first plurality of electrodes is ≥5.

12. The method of claim 1, wherein at least x electrodes in said first plurality of electrodes have different lengths, wherein x is selected from the group consisting of:>2; >3; >4; >5; >6; >7; >8; >9; >10; >15; >20; >25; >30; >35; >40; >45; >50; >60; >70; >80; >90; and >100; and/or wherein at least y electrodes in said second plurality of electrodes have different lengths, wherein y is selected from the group consisting of:>2; >3; >4; >5; >6; >7; >8; >9; >10; >15; >20; >25; >30; >35; >40; >45; >50; >60; >70; >80; >90; and >100.

13. A mass spectrometer or ion mobility spectrometer comprising a device formed according to claim 1 wherein the charged particles are ions.

14. A device for manipulating charged particles using an axial electric field as they travel along a longitudinal axis of the device, said device comprising:

a first plurality of electrodes arranged along the longitudinal axis of the device, wherein the lengths of the electrodes in the direction along the longitudinal axis of the device vary as a function of the distance along the longitudinal axis of the device;

one or more first DC voltage supplies connected to said first plurality of electrodes, wherein the one or more DC voltage supplies are configured to apply one or more DC voltages to the first plurality of electrodes in use;

a second plurality of electrodes arranged along the longitudinal axis of the device, wherein one of the second plurality of electrodes is arranged between each longitudinally adjacent pair of electrodes in the first plurality of electrodes;

one or more second DC voltage supplies connected to said second plurality of electrodes, wherein the DC voltage supply is configured to maintain each of the second plurality of electrodes at a DC voltage in use;

wherein the first and second plurality of electrodes are arranged along the longitudinal axis of the device and the first and second voltage supplies are selected such that an electric potential profile is established along the longitudinal axis of the device in use; and wherein said one or more first DC voltage supplies and/or said one or more second DC voltage supplies are configured to be pulsed on and off for pulsing the electrical potential profile on and off.

15. The device of claim 14, wherein the device is an ion mirror, or an acceleration region or reflectron of a Time of Flight mass analyser.

16. The device of claim 15, wherein the device is a Time of Flight mass analyser, wherein the device is configured so that ions enter the device orthogonal to the longitudinal axis, and wherein the device is configured to pulse or establish said electric potential profile along the entire length of the longitudinal axis of the device such that ions are accelerated along the longitudinal axis and separate according to their mass to charge ratios.

17. A method of manipulating charged particles, or a method of mass spectrometry or ion mobility spectrometry comprising:

providing the device or spectrometer of claim 14;

applying said one or more voltages to the first plurality of electrodes with said one or more first voltage supplies, and applying said one or more voltages to the second plurality of electrodes with said one or more second voltage supplies, such that a non-linear electric potential profile is established along a longitudinal axis of the device; and manipulating charged particles using the electric potential profile as they travel along the longitudinal axis of the device.

* * * * *